US005339495A

United States Patent [19]

Haworth et al.

[11] Patent Number: 5,339,495

[45] Date of Patent: Aug. 23, 1994

[54] COILER AND AUTOLEVELLER

[75] Inventors: Walter Haworth, Rossendale; John Whiteley, Clitheroe; Alfred Wood, Greater Manchester; Stephen W. Yates, Harwood, all of United Kingdom

[73] Assignee: Hollingsworth (U.K.) Ltd., Acrington, United Kingdom

[21] Appl. No.: 981,050

[22] Filed: Nov. 24, 1992

[30] Foreign Application Priority Data

Nov. 26, 1991 [GB] United Kingdom ..... 9125094.4
Mar. 10, 1992 [GB] United Kingdom ..... 9205179.6

[51] Int. Cl.[5] ..... D04H 11/00

[52] U.S. Cl. ..... 19/159 R; 19/106 R; 19/236; 474/29

[58] Field of Search ..... 19/159 R, 159 A, 157, 19/150, 0.23, 0.24, 236, 239, 240, 241, 106 R, 258, 98; 474/29, 58, 59

[56] References Cited

U.S. PATENT DOCUMENTS

| | | | |
|---|---|---|---|
| 2,310,581 | 2/1943 | Garrett, Sr. | 19/159 R |
| 2,322,711 | 6/1943 | Gwaltney et al. | 19/157 |
| 2,810,936 | 10/1957 | Altenburger | 19/159 R |
| 3,402,433 | 9/1968 | Schwalm | 19/159 R |
| 4,389,751 | 6/1983 | Gyger et al. | 19/0.35 |
| 4,539,729 | 9/1985 | Meile et al. | 19/288 |
| 4,646,387 | 3/1987 | Oswald et al. | 19/0.23 |
| 4,646,387 | 3/1987 | Oswald et al. | 19/0.23 |
| 5,095,587 | 3/1992 | Kluttermann et al. | 19/159 R |
| 5,111,551 | 5/1992 | Hollingsworth et al. | 19/159 R |

FOREIGN PATENT DOCUMENTS

| | | | |
|---|---|---|---|
| 0078393 | 9/1982 | European Pat. Off. . | |
| 0192835 | 12/1985 | European Pat. Off. . | |
| 0314310 | 3/1989 | European Pat. Off. . | |
| 0354653 | 2/1990 | European Pat. Off. . | |
| 0512683 | 3/1992 | European Pat. Off. . | |
| 81/00118 | 1/1981 | Fed. Rep. of Germany . | |
| 343933 | 8/1972 | U.S.S.R. | 19/159 R |
| 564577 | 10/1944 | United Kingdom . | |
| 750086 | 6/1956 | United Kingdom . | |
| 941405 | 11/1963 | United Kingdom . | |
| 967366 | 8/1964 | United Kingdom . | |
| 1436029 | 5/1976 | United Kingdom . | |
| 2216909A | 10/1989 | United Kingdom . | |
| 2221669A | 2/1990 | United Kingdom . | |

*Primary Examiner*—Clifford D. Crowder
*Assistant Examiner*—Michael A. Neas
*Attorney, Agent, or Firm*—Leatherwood, Walker, Todd & Mann

[57] ABSTRACT

This invention relates to a coiler using tongue and groove rollers preferably for measuring sliver thickness and guiding sliver emerging from between these rollers, using guide means such as a pair of calender rollers driven for rotation in the same conveying direction.

Optionally the sliver between the conveying nip at the tongue and groove rollers and the guide means (when embodied as calender rollers) is severed by intermittent operation of the conveying and guiding nips.

8 Claims, 2 Drawing Sheets

COILER AND AUTOLEVELLER

BACKGROUND OF THE INVENTION

The present invention relates to a sliver coiler. One particular embodiment of the invention relates to a coiler adapted to measure the thickness of sliver being deposited into a plurality of successive cans in the coiler.

SUMMARY OF THE INVENTION

According to the present invention there is provided a coiler including a tongue and groove roller pair defining a conveying nip through which the sliver being coiled is passed; and guide means, downstream from said conveying nip, for guiding the advancing sliver emerging from the conveying nip along a direction for discharging the sliver into a can.

BRIEF DESCRIPTION OF THE DRAWINGS

In order that the present invention may more readily be understood the following description is given, merely by way of example, with reference to the accompanying drawing, in which.

DETAILED DESCRIPTION OF THE PREFERRED EMBODIMENTS

Figure 1:
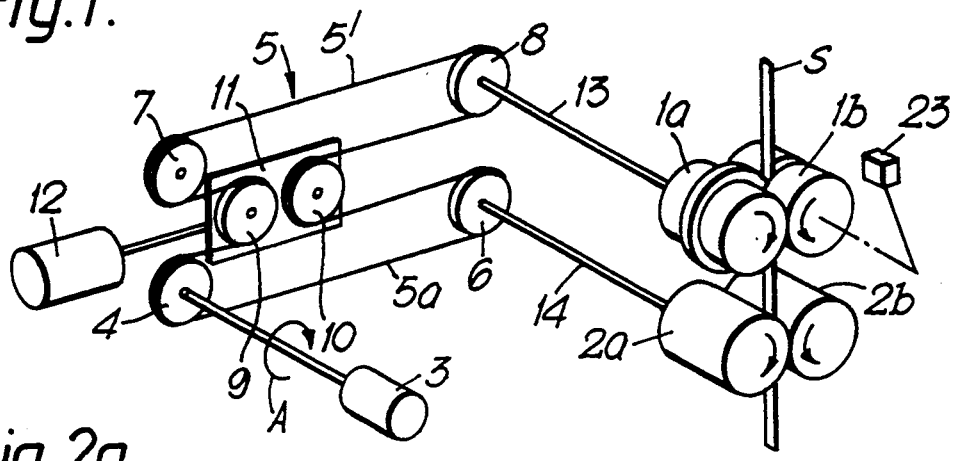
FIG. 1 is a perspective view of two pairs of calender rollers of a coiler, and of the drive to these calender roller pairs.

The perspective view of FIG. 1 shows a pair of tongue and groove input calender rollers 1*a* and 1*b*, respectively, and a pair of delivery calender rollers 2*a* and 2*b*, whereby the input calender rollers 1*a* and 1*b* define a conveying nip and the delivery calender rollers 2*a* and 2*b* define a guide means to advance the sliver S onward from the conveying nip as it passes through the two nips in sequence.

Figure 3:
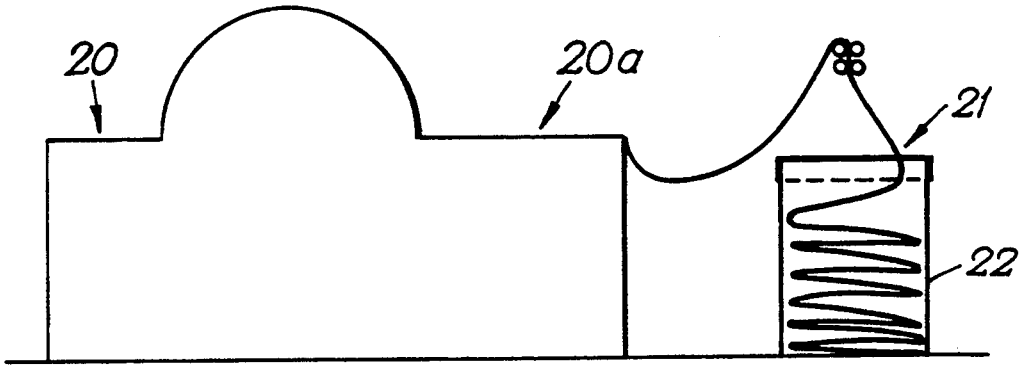
FIG. 3 shows a side elevational view of the coiler as a whole, the input and delivery calender rollers 1*a*, 1*b* and 2*a*, 2*b* at the coiler head.

In this case the tongue and groove rollers 1*a* and 1*b*, respectively, and the delivery pair of calender rollers 2*a*, 2*b* are driven in unison at a common speed which may vary in dependence upon the operation of an autoleveller of a card 20 (FIG. 3) which is supplying the carded web to form the sliver S to be coiled in the can 22 by the coiler 21 (FIG. 3). One particularly suitable form of coiler drive to synchronize operation of the coiler to that of the final drafting rollers of the card autoleveller is that disclosed and claimed in our British Patent Application 9109371.6 and our corresponding co-pending U.S. patent application Ser. No. 07/875,892, the disclosure of which is incorporated herein by reference. This uses a drive similar to that shown in FIG. 4, but with a sliver guide roller carried by the carrier 11, to lengthen and shorten the sliver path between card and coiler.

The nip between these two rollers 1*a* and 1*b* is yieldable by virtue of movement of at least one of the two rollers laterally away from the other in response to the thickness of the sliver S passing through the groove in the roller 1*b*, in the conventional manner for an autoleveller sliver sensing system.

FIG. 1 shows that in this case it is the groove roller 1*b* which is movable, and that its position is detected by a transducer 23.

From the groove in the grooved roller 1*b* the sliver S moves along towards the nip between the rollers 2*a*, 2*b* along a path which is generally tangential to the groove and to the top of the tongue of roller 1*a*, i.e. the sliver follows a rectilinear path through the two nips. There is no net draft through the nips 1*a*, 1*b* and 2*a*, 2*b* because the surface speed of the top of the tongue and the floor of the groove is substantially identical to that of each of the calender rollers.

It is thus possible to have a continuous monitoring of the sliver thickness at the coiler. It has been found that the close juxtaposition of the delivery calender rollers 2*a* and 2*b* with the tongue and groove roller pair 1*a*, 1*b* provides for uniform alignment of the sliver passing through the tongue and groove roller pair.

While this juxtaposed pair of calender rollers and tongue and groove rollers is exemplified in the embodiment illustrated in FIGS. 1 to 5 as being in the form of a measurement calender roller set on a coiler, we believe that the improved action of the juxtaposed tongue and groove rollers and guide means can be used without the downstream calender rollers 2*a* and 2*b*.

The normal synchronized operation of the tongue and groove calender rollers 1*a* and 1*b* and the delivery pair of calender rollers 2*a* and 2*b* is temporarily disturbed when severing is required, in such a way that the surface speed of the input rollers 1*a* and 1*b* in the sliver advancing direction (vertically downward in FIG. 1) is less than that of the pair of delivery rollers 2*a* and 2*b*. This temporary effect may be achieved either by accelerating the delivery rollers 2*a* and 2*b*, or retarding the tongue and groove rollers 1*a* and 1*b*, or even reversing the tongue and groove rollers 1*a* and 1*b*, or by any combination of these effects.

When there is a sufficient difference in peripheral speeds between the tongue and groove rollers 1*a* and 1*b* and the calender rollers 2*a* and 2*b*, the sliver between the conveying nip at 1*a* and 1*b* and the delivery rollers will be drafted to breaking point, provided (i) the amplitude of the differential movement of the roller surfaces is at least equal to the staple length of the fiber forming the sliver, and provided that (ii) the magnitude of the speed change of the conveying nip at 1*a* and 1*b* relative to the instantaneous speed of the delivery rollers 2*a* and 2*b* is at least equal to the forward delivery speed of the sliver S.

If the second of these conditions is not met, but the first is, then the tongue and groove rollers 1*a* and 1*b* will continue to advance the sliver but at a rate less than the rate of advance imparted by the calender rollers 2*a* and 2*b*, and the sliver will be drafted in a conventional manner without any guarantee of severing (unless of course the magnitude of the differential motion is substantially greater than the sliver staple length to ensure that sufficient drafting occurs for severing to result).

Drive to the various rollers 1*a*, 1*b*, 2*a*, 2*b* is generated by a prime mover or drive means, in this case a motor 3, to drive a belt pulley 4 around which a belt 5 passes.

The path of the belt 5 is shown in FIG. 1 as involving a further pulley 6 at the other end of a run 5a which includes both the pulleys 4 and 6, and third and fourth pulleys 7 and 8 on a run 5 of the belt 5.

Between pulleys 4 and 7 the belt forms a loop over a pulley 9, and between pulleys 6 and 8 it defines a loop over a pulley 10, with the pulleys 9 and 10 carried by a common carrier 11 driven leftwardly and rightwardly by a linear actuator 12. The axes of the pulleys 9 and 10 are fixed on the carrier 11 so that the belt 5 is not unduly stretched by the movement of the carrier 11 (apart of course from the changes in tension due to inertias of the driven calender rollers 1*a*, 1*b*, 2*a* and 2*b* on the one hand and of the drive means such as the drive motor 3, on the other hand).

The linear actuator 12 may be an electrically operated linear actuator, or a hydraulic ram, or a pneumatic ram.

When the linear actuator 12 is stationary it holds the carrier 11 in a fixed position, and driving motion of the drive means 3 in the direction of arrow A will rotate the four pulleys 4, 6, 7 and 8 in the clockwise direction (and the pulleys 9 and 10 in the anti-clockwise direction) and will thereby drive the left hand upper (tongue) roller 1*a* and calender roller 2*a* in the clockwise sense, by virtue of their respective drive shafts 13 and 14. The right hand upper (groove) roller 1*b* and calender roller 2*b* are idler rollers which are driven frictionally in the anti-clockwise direction by the driven rollers 1*a* and 2*a*.

Differential movement of the conveying (tongue and groove) rollers and the guide (calender) rollers is achieved by changing the position of the carrier 11 by means of actuation of the linear actuator 12. This is best appreciated by referring to FIGS. 2*a* to 2*d* where four separate positions of the carrier 11 are shown at $\mathbf{11}_1$ (FIG. 2*a*), $\mathbf{11}_2$ (FIG. 2*b*), $\mathbf{11}_3$ (FIG. 2*c*), and $\mathbf{11}_4$ (FIG. 2*d*).

Figure 2A:
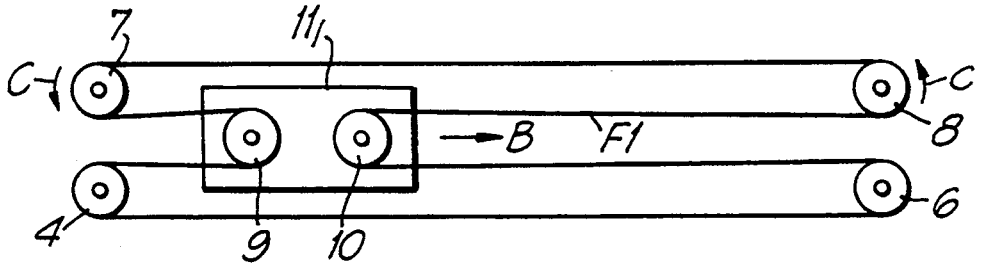
FIG. 2*a* is a view of the drive belt shown in FIG. 1, while the support pulleys are in a "home" position effective during normal drive of the coiler calender rollers.

In the "home" position $\mathbf{11}_1$ shown in FIG. 2*a*, effective during normal operation of the coiler, the variations in speed of the guide calender rollers 2*a* and 2*b* will be reflected by the variations in speed of the tongue and groove rollers 1*a* and 1*b* rotating in synchronism with them, and will be controlled by the autoleveller 20*a* of the card 20. Examination of FIG. 2*a* will show that with the carrier stationary in the position $\mathbf{11}_1$, the pulleys 8 and 6 will be rotating at the same velocity in the clockwise sense. If now the pulley 4 driven by the drive means 3 is stationary, as shown in FIGS. 2*a* to 2*d*, and the carrier 11 is displaced rightwardly from the position $\mathbf{11}_1$ in the direction of the arrow B in FIG. 2*a*, the pulley 6 driving the driven calender roller 2*a* by virtue of shaft 14 will be stationary while the pulley 8 driving the driven (tongue) conveying roller 1*a* via its drive shaft 13, and the idler pulley 7, will begin to rotate in the counterclockwise, or, anticlockwise direction as shown by arrow C.

Figure 2B:
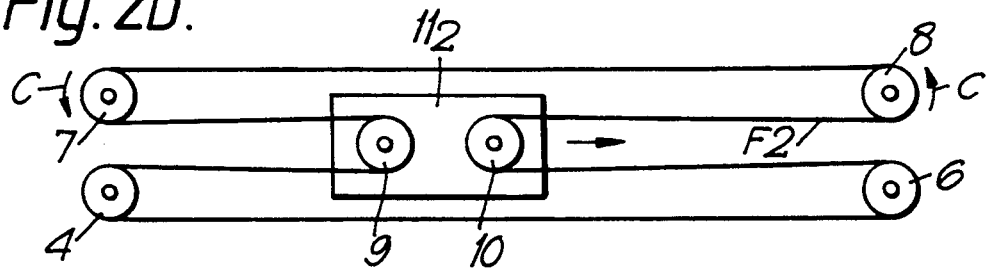
FIGS. 2*b*, 2*c* and 2*d* depict various positions of the two movable pulleys of the drive mechanism of FIG. 1, during traversing of a carrier for these two movable pulleys from the "home" position shown in FIG. 2*a* to an "away" position shown in FIG. 2*d;*

During continued movement of the carrier 11 through the position $\mathbf{11}_2$ in FIG. 2*b*, the upper pulley 8 continues to rotate anticlockwise in the direction of arrow C, and the upper pulley 7 maintains its anticlockwise motion as again shown in FIG. 2*b*.

Figure 2C:
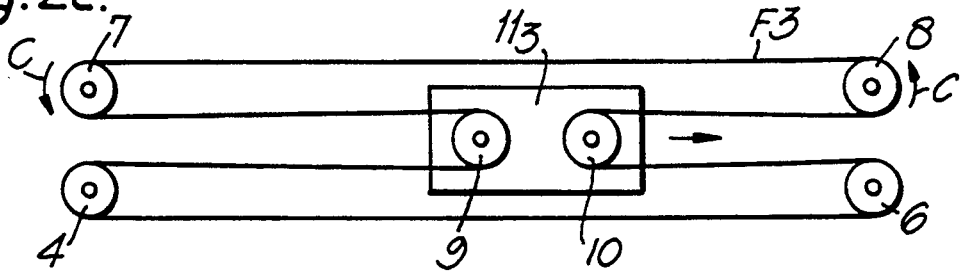
Figure 2D:
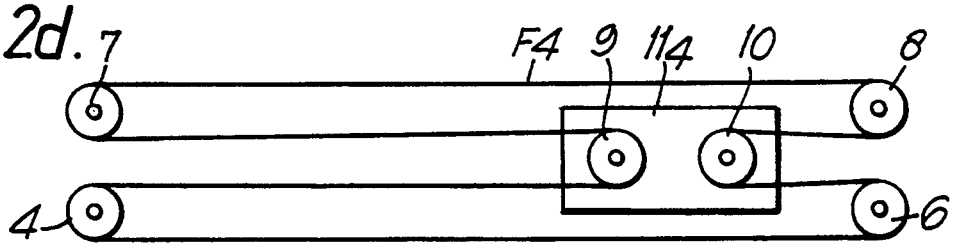

When the carrier 11 is in the position $\mathbf{11}_3$ shown in FIG. 2*c*, this anticlockwise rotation of the upper pulleys 7 and 8 will continue while the lower pulleys 4 and 6 remain stationary.

Upon termination of the rightward movement, the carrier 11 arrives at the "away" position $\mathbf{11}_4$ shown in FIG. 2*d* and the two upper pulleys 7 and 8 will then have ceased to rotate.

If we now superimpose a continuous clockwise rotation of the pulley 4 on the above configurations of FIGS. 2*a*, 2*b*, 2*c* and 2*d*, it will be seen that in FIG. 2*a* the lower pulleys 4 and 6 will be rotating clockwise at a first angular velocity while the upper pulleys 7 and 8 will either by rotating clockwise with a lower angular velocity (i.e. the angular velocity of the pulleys 4 and 6 minus the angular velocity of pulleys 7 and 8 in direction C), or indeed be rotating in the reverse direction if the magnitude of the rotation in direction C exceeds the magnitude of the clockwise rotation of pulleys 4 and 6.

The same will apply in FIG. 2*b*, and in FIG. 2*c*, but by FIG. 2*d* all four pulleys 4, 6, 7 and 8 will be rotating in unison in the clockwise direction (i.e. at a common angular velocity).

In order to illustrate the amplitude of the differential motion, a point F on the belt 5 is shown in FIG. 2*a* as point $F_1$, and then travels through locations $F_2$ (FIG. 2*b*), and $F_3$ (FIG. 2*c*), to location $F_4$ when the carrier 11 is in the "away" position $\mathbf{11}_4$.

The magnitude of the anticlockwise motion of the pulleys 6 and 8 relative to a stationary pulley 4, in the direction of arrow C, will depend upon the magnitude of the linear motion of the carrier 11 in direction B. Thus for best severing action a rapid rightward traverse of the carrier 11 from the "home" position $\mathbf{11}_1$ to the "away" position $\mathbf{11}_4$ is advantageous.

However, this retardation of the tongue and groove rollers 1*a* and 1*b* will generate slack in the coiler between the output from the card 20 and the tongue and groove rollers 1*a* and 1*b* of the coiler 21. This slack is taken up without snatching during the return movement of the carrier 11 from the "away" position $\mathbf{11}_4$ to the "home" position $\mathbf{11}_1$.

From the above description it will be clear that when, at the end of normal operation of the coiler, the linear actuator 12 drives the carrier 11 rapidly rightwardly from the "home" position (FIG. 2*a*) to the "away" position (FIG. 2*d*) the tongue and groove rollers 1*a* and 1*b* will rapidly retard to sever the sliver, and will then gently accelerate again to reintroduce that end of the sliver which is still clamped between the tongue and groove rollers 1*a* and 1*b* back into the nip between the calender rollers 2*a* and 2*b* during the commencement of coiling in the next empty can.

The establishment of a differential of movement between the tongue and groove rollers 1*a* and 1*b* and the calender rollers 2*a* and 2*b* can be achieved in various alternative ways apart from that shown in FIG. 1.

Figure 4:
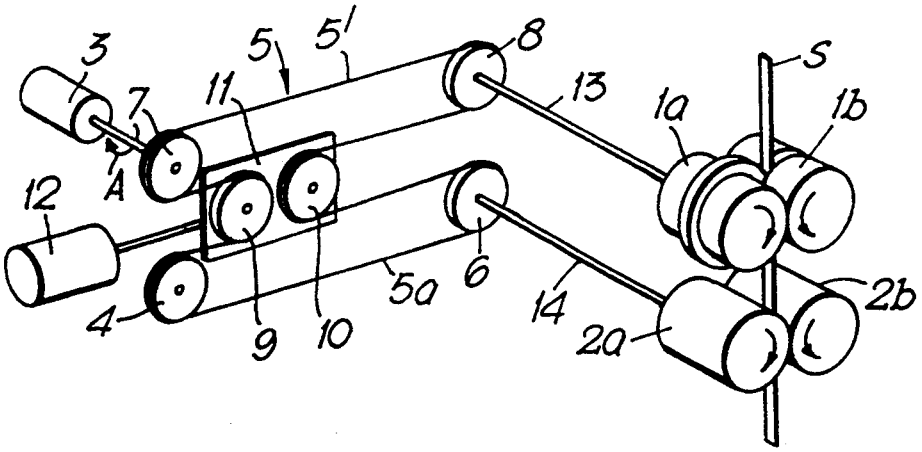
FIG. 4 shows a modified form of the apparatus of FIG. 1.

One alternative possibility is shown in FIG. 4 where the drive means 3 now drives the pulley 7. This will result in the pulley 8, the drive shaft 13 and the driven tongue roller 1*a* being driven clockwise at the same rate as the drive means 3, whereas the lower pulleys 4 and 6, together with the drive shaft 14 and the calender roller 2*a* driven thereby will rotate in the anticlockwise direction but at a speed which depends upon the motion of the carrier 11. As the carrier 11 moves from the "home" position of FIG. 2*a* to the "away" position of FIG. 2*d*, the calender rollers 2*a* and 2*b* will accelerate to sever the sliver between the upper and lower rollers while intake of the sliver from the card 20 will be such as to avoid the generation of slack. In this case the rate of return of the carrier 11 to the "home" position of FIG. 2*a* is less critical.

Figure 5:
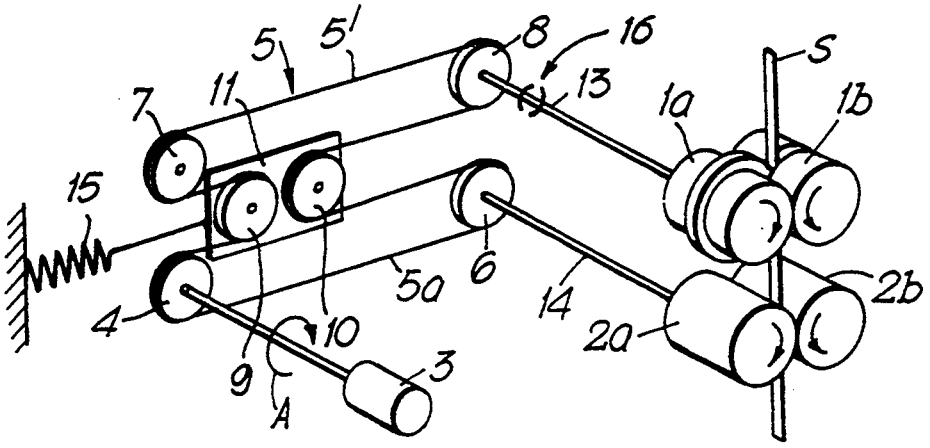
FIG. 5 shows yet a further modified form of the apparatus of FIG. 1.

A third possibility for the control of the four rollers 1*a*, 1*b*, 2*a*, 2*b* is shown in FIG. 5 where the linear actuator 12 is replaced by a tension spring 15 biasing the carrier 11 towards its "home" position, where it will be held by a stop (not shown). In this case the drive means 3 still drives the pulley 4, as in FIG. 1, but rotation of the tongue and groove rollers 1*a* and 1*b* is controlled by a friction brake 16 on the drive shaft 13 from the pulley 8 to the driven calender roller 1*a*.

When the brake 16 is applied to the shaft 13, the slide 11 will be drawn rightwardly by virtue of the belt tension to extend the spring 15 while the calender rollers 2*a* and 2*b* rotate at a substantially synchronized speed in relation to the speed of the autoleveller of the card.

As soon as the carrier 11 reaches the "away" position defined by a further stop (not shown) and detected by a limit switch (not shown), the friction brake 16 will be released and the spring 15 able to contract to draw the carrier 11 back to its "home" position to reestablish stable operating conditions during the filling of the next sliver can.

An alternative possibility would be to use the spring shown in FIG. 5, but with the drive means 3 driving the pulley 7 as in FIG. 4, and then to provide for some means of accelerating the shaft 14 to establish the necessary differential of motion (rather than relying on a friction brake 16 on the shaft 13 to retard the tongue and groove rollers 1*a* and 1*b* as in FIG. 5).

For achieving the desired differential motion between the upper (conveying) nip 1*a*, 1*b* and the lower (guide) calender nip 2*a*, 2*b* an air motor is normally quiescent on the shaft 14 to the delivery calender roller nip 2*a*, 2*b*, but is able to impart rapid temporary acceleration to the shaft 14 when a pulse of driving air is applied to the motor, thereby displacing the carrier 11 from the "home" position $\mathbf{11}_1$ to the "away" position $\mathbf{11}_4$ against the restoring bias of the spring 15. Termination of the pulse of air will of course be triggered by the same limit switch which, in the embodiment of FIG. 5, releases the friction brake 16.

Yet a further possibility allows for both a friction brake on the upper drive shaft 13 and an accelerating motor on the lower drive shaft 14 to provide a composite of these two effects to generate the necessary motion differential between the conveying nip 1*a*, 1*b* and the guide nip 2*a*, 2*b* and a more brutal speed differential to achieve severing.

As shown in FIG. 3, the rollers 1*a*, 1*b* and 2*a*, 2*b* are on generally stationary axes overhead the coiler 21 on the axis of the coiler head, and then the sliver emerging from the nip between the calender roller 2*a*, 2*b* passes down along an orbiting inclined path to pass through the tube wheel of the coiler at an orbiting aperture.

In all of the embodiments of the present invention, the fact that the rollers are mounted centrally above the coiler and deliver the sliver to a conduit which is inclined with respect to the axis of the coiler so that the inlet end remains on that axis and the delivery end orbits around the axis at its point of emergence from the underside of the coiler tube wheel, ensures that the effects on the uniformity of the sliver due to passing through the two roller pairs 1*a*, 1*b* and 2*a*, 2*b* are uniform whereas this would not be so easy to provide for if the calender rollers were mounted on the tube wheel, i.e. at the lower end of an inclined run of sliver from the sliver guide on the coiler axis to the orbiting point of sliver emergence through the tube wheel.

Although not shown in the drawings, the tongue and groove input rollers 1*a* and 1*b* can separate from one another in a direction transverse to the sliver path, and so also can the guide calender rollers 2*a* and 2*b*, in order to allow cleaning of the rollers in the event of a "jam" or "lap".

Although the drive means 3 in FIGS. 1, 4 and 5 is exemplified as a motor, it is possible for this drive to be provided by a fixed ratio transmission from another part of the apparatus, for example the doffer of the card 20, or by a variable ratio transmission such as an epicyclic gear box in the case where the card is equipped with an autoleveller.

The belt 5 may be a toothed belt and the pulleys 4, 6, 7, 8, 9 and 10 are also then toothed belt pulleys.

Although in the above description it is the tongue roller 1*a* which is always the driven roller, while the groove roller 1*b* is the idling roller, it is of course possible for these two rollers to be reversed in function so that it is the groove roller which drives and the tongue roller which idles.

Other means than calender rollers 2*a* and 2*b* can be used to guide the sliver S neatly from the conveying nip at the tongue and grooved roller pair 1*a*, 1*b*. One possibility is for a belt arrangement similar to a pair of drafting aprons, but operated substantially without draft relative to the conveying nip 1*a*, 1*b*. Another possibility is for a guide plate to be positioned in order to strip the sliver S from the groove of the roller 1*b* and/or from the tongue of the roller 1*a*.

It will be appreciated from the above that the calender roller pair 2*a*, 2*b* illustrated in the various drawings provide for an active guide means, and so also would the non-illustrated "apron" belt arrangement, whereas the stripper plate (s) provide a passive guide means which would depend on some other means such as sliver weight in order to advance the sliver past the guide means.

As indicated above, merely using a tongue and groove roller pair such as rollers 1*a* and 1*b* in the coiler head, i.e. at a position close to the point of discharge of the sliver into the sliver can, offers distinct advantages over prior art coilers. In particular, the compacting of the sliver at the tongue and groove roller pair 1*a*, 1*b* is such that the same sliver does not get a chance to become bulked again before discharge into the can, so the cross-section of the sliver entering the can is smaller than hitherto and it has been found that this can result in at least a 10% increase in the length of sliver able to be packed in a particular can.

The measurement of the mutual spacing between the axes of the tongue and groove rollers 1*a* and 1*b* offers the further advantage of being able to provide continuous monitoring of the thickness of the sliver, for the purposes of ensuring that the degree of autolevelling is accurate throughout operation of the coiler. This provides for "real time" measurement without the need for periodic sampling and testing. Due to the good alignment of the fibers in the autolevelled sliver, the accuracy of this downstream "on-line" measurement approaches that of an "off-line" quality control laboratory.

The use of a driven (driven in synchronism with the card delivery rollers) tongue and groove rollers as the thickness sensor has the advantage that the sensing accuracy is constant because as the card delivery speed changes (during the autolevelling) so also does the speed of the tongue and groove rollers. Any other form of sliver thickness sensor (such as an ultrasonic sensor or a pressure-responsive sensor) would be subject to varying accuracy as the card delivery speed changes.

The further preferred arrangement, in which there is a downstream calender roller arrangement such as *2a*, *2b* to provide for severing of the sliver without the need to re-thread the sliver before resumption of coiling, is representative of a still further advantage of the preferred coiler illustrated in the accompanying drawings.

As indicated above, the drive between the card and the coiler is preferably as described and claimed in our British Patent Application No. 9109371.6, and our corresponding co-pending U.S. patent application Ser. No. 07/875,892, using for the drive an arrangement similar to FIG. 4 of the present application, with the pulley 7 driven by the autoleveller of the card, and the pulley 4 driving the drive to the coiler, and with a loop in the sliver path arranged such that it increases and decreases in length simultaneously with, and by the same amount as, the loop extending from the driven pulley (4) to the driving pulley (7) via the floating pulley (9).

We claim:

1. A textile apparatus comprising:

carding means for carding fibers and for producing at least one sliver from the carded fibers;

autoleveling means associated with said carding means for autoleveling the sliver produced by said carding means;

coiler means for receiving the sliver after the sliver has been autolevelled by said autoleveling means and for coiling the sliver in storage cans, said coiler means including a tongue and groove roller pair through which a sliver being coiled in a can is passed, said tongue and groove roller pair defining a first conveying nip of variable width responsive to the thickness of the sliver therein and including means responsive to the width of said first conveying nip for registering sliver thickness; and a pair of driven calendar rollers immediately downstream from said first conveying nip, for guiding the advancing sliver emerging from said first conveying nip along a direction towards said can, said calendar rollers defining a second conveying nip therebetween.

2. A coiler according to claim 1, and including means for establishing a temporary increase in draft between the said first conveying nip and said second conveying nip for drafting said sliver to breaking point, whereafter the draft may be reduced to allow continuation of sliver feed.

3. A coiler according to claim 2, including a drive means and a drive train connected to said drive means for driving said first and second conveying nips; and wherein said means for establishing a temporary increase in draft is connected in said drive train between said drive means and the first and second conveying nips.

4. A coiler according to claim 3, wherein said drive train includes:

first to sixth pulleys;

a belt entrained over said first and second pulleys defining a first belt run, said third and fourth pulleys defining a second belt run of said belt;

a displaceable carrier carrying said fifth and sixth pulleys with the axes of said fifth and sixth pulleys being fixed to said carrier and said fifth and sixth pulleys being free to rotate, said belt defining a first loop between said first and third pulleys and a second loop between said second and fourth pulleys, whereby said fifth pulley engages said first loop of the belt between said first and third pulleys and said sixth pulley engages said second loop of the belt between said second and fourth pulleys; and means for generating movement of said carrier in a direction parallel to said first and second belt runs.

5. A coiler for use in coiling sliver transported by a sliver machine into a can, the coiler comprising:

a tongue and groove roller pair defining a first conveying nip therebetween through which sliver being coiled in the can may pass;

guide means downstream from said conveying nip, for guiding the advancing sliver emerging from the conveying nip along a direction for discharging the sliver into said can;

said guide means including a pair of driven calender rollers downstream from said first conveying nip, for guiding the advancing sliver emerging from said first conveying nip along a direction towards the can, said calender rollers defining a second conveying nip therebetween;

drafting means for establishing a temporary drafting of the sliver between said first conveying nip and said second conveying nip for drafting sliver to the breaking point of the sliver; and said drafting means allowing for a reduction of drafting and for continuation of sliver feed through said first and second conveying nips; and said drafting means including flexible element drive means for drivingly rotating said tongue and groove roller pair and said pair of driven calender rollers; said flexible element drive means including a displaceable carrier associated therewith for selectively varying, upon displacement of said displaceable carrier, the relative rotational speeds of said tongue and groove roller pair and said pair of driven calender rollers to establish said temporary drafting.

6. A coiler as defined in claim 5, wherein said tongue and groove roller pair defines a gap of variable width responsive to the thickness of the sliver therein; and further comprising means associated with said tongue and groove roller pair responsive to the width of said first conveying nip for measuring sliver thickness.

7. A coiler as defined in claim 5, further comprising a drive means having a drive train connected thereto for driving said first and second conveying nips; and wherein said drafting means for establishing a temporary increase in draft of the sliver is connected in said drive train between said drive means and said first and second conveying nips.

8. A coiler as defined in claim 7, wherein said drive train comprises:

a first, a second, a third, a fourth, a fifth, and a sixth pulley;

said belt drive means including a belt entrained over said first and second pulleys defining a first belt run, and said belt being entrained over said third and fourth pulleys defining a second belt run of said belt; said belt defining a first loop between said first and second pulleys and a second loop between said second and fourth pulleys;

said displaceable carrier carrying said fifth and sixth pulleys for rotation with respect to said displaceable carrier, whereby said fifth pulley engages said first loop of said belt between said first and third pulleys and said sixth pulley engages said second loop of said belt between said second and fourth pulleys; and displacement means associated with said displaceable carrier for generating reciprocating movement of said displaceable carrier in directions substantially parallel to said first and second belt runs.

* * * * *